US010174732B2

(12) United States Patent
Woerz et al.

(10) Patent No.: US 10,174,732 B2
(45) Date of Patent: Jan. 8, 2019

(54) METHOD AND DEVICE FOR CONTROLLING A HIGH-PRESSURE FUEL PUMP IN AN INTERNAL COMBUSTION ENGINE

(71) Applicant: Robert Bosch GmbH, Stuttgart (DE)

(72) Inventors: Alexandra Woerz, Schwieberdingen (DE); Arthur Pichlkostner, Bietigheim-Bissingen (DE); Burkhard Hiller, Oberriexingen (DE); Robert Schmidt, Karlsruhe-Durlach (DE); Torsten Baumann, Eppingen-Adelshofen (DE); Julia Schmidt, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 59 days.

(21) Appl. No.: 15/525,334

(22) PCT Filed: Nov. 10, 2015

(86) PCT No.: PCT/EP2015/076181

§ 371 (c)(1),
(2) Date: May 9, 2017

(87) PCT Pub. No.: WO2016/091515

PCT Pub. Date: Jun. 16, 2016

(65) Prior Publication Data

US 2017/0321644 A1 Nov. 9, 2017

(30) Foreign Application Priority Data

Dec. 11, 2014 (DE) ..... 10 2014 225 528

(51) Int. Cl.
*F02D 41/38* (2006.01)
*F02M 59/10* (2006.01)
(Continued)

(52) U.S. Cl.
CPC ..... *F02M 59/102* (2013.01); *F02D 41/009* (2013.01); *F02D 41/3836* (2013.01);
(Continued)

(58) Field of Classification Search
CPC ..... F01L 1/047; F01L 2001/34453; F01L 2013/111; F01L 2013/113;
(Continued)

(56) References Cited

U.S. PATENT DOCUMENTS 4,308,839 A * 1/1982 Hafner ..... F02M 59/30 123/496
2001/0006061 A1* 7/2001 Shimada ..... F02D 41/062 123/495
(Continued)

FOREIGN PATENT DOCUMENTS

DE 102004019152 A1 11/2005
EP 2169203 A1 3/2010
(Continued)

OTHER PUBLICATIONS

International Search Report dated Mar. 7, 2016, of the corresponding International Application PCT/EP2015/076181 filed Nov. 10, 2015.

*Primary Examiner* — Jorge Leon, Jr.
(74) *Attorney, Agent, or Firm* — Norton Rose Fulbright US LLP; Gerard Messina

(57) ABSTRACT

A method for controlling a high-pressure pump for the injection of fuel into a combustion engine, the high-pressure pump being connected to a camshaft of the combustion engine, wherein the high-pressure pump is controlled in a camshaft-synchronous manner by ascertaining an angular offset between the flank positions of a camshaft pulse-
(Continued)

generating wheel and a predefinable point above the bottom dead center of a cam of the high-pressure pump on the camshaft.

8 Claims, 3 Drawing Sheets

(51) Int. Cl.

| | |
|---|---|
| ***F02D 41/00*** | (2006.01) |
| ***F02M 37/00*** | (2006.01) |
| ***F02M 39/02*** | (2006.01) |
| ***F02M 63/02*** | (2006.01) |
| ***F04B 9/04*** | (2006.01) |
| *F01L 13/00* | (2006.01) |
| *F01L 1/047* | (2006.01) |
| *F01L 1/344* | (2006.01) |
| *F02D 41/40* | (2006.01) |
| *F02M 59/36* | (2006.01) |

(52) U.S. Cl.
CPC ..... *F02D 41/3845* (2013.01); *F02D 41/3854* (2013.01); *F02M 37/0058* (2013.01); *F02M 39/02* (2013.01); *F02M 63/0245* (2013.01); *F04B 9/042* (2013.01); *F01L 1/047* (2013.01); *F01L 2001/34453* (2013.01); *F01L 2013/111* (2013.01); *F01L 2013/113* (2013.01); *F01L 2820/041* (2013.01); *F01L 2820/042* (2013.01); *F02D 41/401* (2013.01); *F02M 59/361* (2013.01)

(58) Field of Classification Search
CPC ..... F01L 2820/041; F01L 2820/042; F02D 41/009; F02D 41/3845; F02M 39/02; F02M 59/102; F02M 63/0245; F04B 9/042
USPC ..... 123/90.16, 90.17
See application file for complete search history.

(56) References Cited

U.S. PATENT DOCUMENTS

| | | | | |
|---|---|---|---|---|
| 2005/0224049 | A1* | 10/2005 | Eser | F02D 41/3845 123/446 |
| 2006/0147317 | A1* | 7/2006 | Okamoto | F02D 41/3845 417/297 |
| 2010/0082223 | A1* | 4/2010 | Toyohara | F02D 41/3845 701/103 |
| 2010/0268441 | A1* | 10/2010 | Yoshiume | F02D 41/062 701/103 |

FOREIGN PATENT DOCUMENTS

| | | | |
|---|---|---|---|
| JP | H11294236 | A | 10/1999 |
| JP | 2003206768 | | 7/2003 |
| WO | 0186131 | A1 | 11/2001 |

* cited by examiner

METHOD AND DEVICE FOR CONTROLLING A HIGH-PRESSURE FUEL PUMP IN AN INTERNAL COMBUSTION ENGINE

FIELD

The present invention relates to a method for controlling a high-pressure pump for the injection of fuel into a combustion engine, the high-pressure pump being connected to a camshaft of the combustion engine. In addition, the present invention relates to a computer program, which is set up to execute each step of the method of the present invention, and to a machine-readable memory medium on which the computer program according to the present invention is stored. Finally, the present invention relates to an electronic control unit, which is designed to control a high-pressure pump for the injection of fuel into a combustion engine with the aid of the method of the present invention.

BACKGROUND INFORMATION

High-pressure pumps for the injection of fuel into a combustion engine, such as high-pressure gasoline pumps, are positioned on one of the camshafts of the combustion engine. In conjunction with a spring, cams specially configured for the high-pressure pump ensure that a piston travel in the high-pressure pump induces a delivery of the fuel into the fuel rail via a non-return valve. The particular fuel quantity per stroke is determined by an electrical actuation of a quantity-control valve (QCV) in the high-pressure pump.

Conventionally, the actuation of the quantity-control valve and the calculation of parameters that are required in this context, such as the pressure acquisition of the rail pressure, the high-pressure control and the actuation angle of the quantity-control valve, are carried out in a time frame of 10 ms, for example. At low engine speeds, this time frame is narrow enough to execute control operations and calculations in a sufficiently precise manner. At high engine speeds, depending on the number of cams, the cam frequency becomes higher than the time frame frequency, and it is no longer possible to incorporate the most recent parameters in the control calculation for each delivery of fuel. In the event that the high-pressure fuel pump is driven by a rapidly adjusted camshaft, the execution of control calculations with old parameters leads to an error. This error is unable to be compensated for in a calculation within the time frame inasmuch as the calculation takes place in an asynchronous manner to the control operation of the high-pressure pump. The error caused by the rapid camshaft adjustment is particularly noticeable at low rotational speeds of the combustion engine. The maximum total error lies in the medium rotational speed range. It manifests itself by pressure oscillations in the fuel rail.

SUMMARY

An example method according to the present invention is used for controlling a high-pressure pump for the injection of fuel into a combustion engine, the high-pressure pump being connected to a camshaft of the combustion engine. According to the present invention, a high-pressure pump is a pump for generating pressure in a fuel rail. 'Connected' in the context of the present invention means that the piston travel of the high-pressure pump is controlled via the camshaft. The high-pressure pump is controlled in synchrony with the camshaft by ascertaining an angular offset between the flank positions of a camshaft pulse-generating wheel and a predefinable point above the bottom dead center of a cam of the high-pressure pump on the camshaft. The cam of the high-pressure pump is to be understood as a cam on the camshaft that controls the piston travel in the high-pressure pump. Hereinafter, it is also referred to as a high-pressure pump cam. Especially at high rotational speeds of the combustion engine, a camshaft-synchronous calculation and control of the high-pressure pump makes it possible to take current parameters into account in the calculation, and also to consider engine-related rotational speed variations in the control operation. In addition, highly dynamic processes as they arise due to the camshaft adjustment are able to be compensated for in the actuation of a quantity-control valve of the high-pressure pump. The latter would be very difficult to achieve when employing a conventional, time-based actuation because the values here would lie far in the future and a prediction would therefore include errors.

A camshaft-synchronous time frame is preferably generated for the camshaft-synchronous control of the high-pressure pump, the result of which is a more precise adjustment of the actual fuel pressure in a fuel rail of the combustion engine to the setpoint pressure, in particular at high rotational speeds of the combustion engine. In combination with a rapid camshaft adjustment, the pressure in the fuel rail thereby becomes more stable, especially at medium rotational speeds of the combustion engine.

The angular offset is preferably taken from a chart in which an angular offset is listed for each flank of the camshaft pulse-generating wheel, and an item of information is allocated to each angular offset indicating whether the respective angular offset is to be taken into account in the control operation. Thus, the item of information is an item of validity information, which is able to be stored as a Boolean value (yes/no) and which indicates whether an angular offset is to be incorporated into a calculation for the control of the high-pressure pump following a specific flank of the camshaft pulse-generating wheel, i.e. whether a task is to be generated. The angular offset values are able to be configured for different camshaft pulse-generating wheels and for different cams on the camshaft allocated to the high-pressure pump; as a result, the method according to the present invention may be used for any combination of camshaft pulse-generating wheel and high-pressure pump cams.

The flank position is ascertained in particular from a signal of a camshaft position sensor, the signal being corrected with regard to a dynamic adjustment of the camshaft. This considers a possible rotation of the camshaft. Additional corrections may be implemented because of mechanical imprecisions, for instance, or because of twisting of the camshaft.

Preferably, the flank positions are ascertained in relation to a crankshaft reference mark of the combustion engine. The crankshaft reference mark corresponds to the angle between the top dead center of a first cylinder of the combustion engine and a second falling flank following a gap in a crankshaft pulse-generating wheel of the combustion engine. Especially preferably, the angle of the top dead center of the first cylinder in relation to the top dead center of the camshaft is ascertained. This allows for a synchronization between the crankshaft of the combustion engine and the camshaft connected to the high-pressure pump.

If no camshaft signal of the camshaft is available, then the high-pressure pump is preferably controlled in synchrony with a substitute value of the camshaft signal. The angular offset will then be ascertained from the substitute value. This makes the transition to a substitute operation, in which all functions for controlling the high-pressure pump are calculated and updated in a substitute-camshaft-synchronous time frame, as seamless as possible, and all required quantities are able to be obtained from the substitute signal.

During a start of the combustion engine with a non-available camshaft signal, the substitute value is preferably ascertained from a signal of a crankshaft position sensor of the combustion engine. This makes it possible to form camshaft-synchronous tasks during the uninterrupted operation of the combustion engine. In so doing, in particular a synchronization for the particular type of combustion engine is carried out on the basis of a method that, for example, may involve an evaluation of crankshaft tooth periods, an intake-pressure evaluation, ignition suppressions, or test injections.

If the camshaft signal is not available while the combustion engine is in operation, a camshaft adjustment of the camshaft is brought into a locked position, and the substitute value is ascertained from a signal of a crankshaft position sensor of the combustion engine with the aid of a clock angle. In this case, a synchronization of the crankshaft to the camshaft already exists since it is basically formed during the engine start, and the engine therefore remains synchronized.

The ascertainment of the substitute value for different calculations that are relevant for controlling the high-pressure pump may be carried out in a variety of individual ways. For example, the calculation and implementation of the substitute value for a EPM packet (engine power management), for instance for hardware-related drivers, for application software, for the camshaft adjustment, and for the task generation, may take place in a different manner in each case.

A return from controlling the high-pressure pump in synchrony with the substitute value to a camshaft-synchronous control operation preferably takes place only if the intensity of a signal from a camshaft position sensor exceeds an applicable threshold value. This avoids constant switching between a normal operation and a substitute operation. It may also be provided to first suppress a return from the substitute operation to the normal operation until the next start of the combustion engine. The switchover from a normal operation to the substitute operation is thereby made permanent for the duration of a drive, which is meaningful, for instance, if the quality of the camshaft pulse-generating wheels is poor.

The computer program according to the present invention executes all of the steps of the method of the present invention, especially when it is running on a computing device or a control unit. This allows the method of the present invention to be implemented on a conventional electronic control unit without any need to carry out structural modifications on the unit. For this purpose, the computer program according to the present invention is stored on the machine-readable memory medium according to the present invention. The electronic control unit according to the present invention is obtained by installing the computer program of present invention in a conventional electronic control unit. The electronic control unit is designed to control a high-pressure pump for the injection of fuel into a combustion engine with the aid of the method according to the present invention.

DETAILED DESCRIPTION OF EXAMPLE EMBODIMENTS

Figure 1:
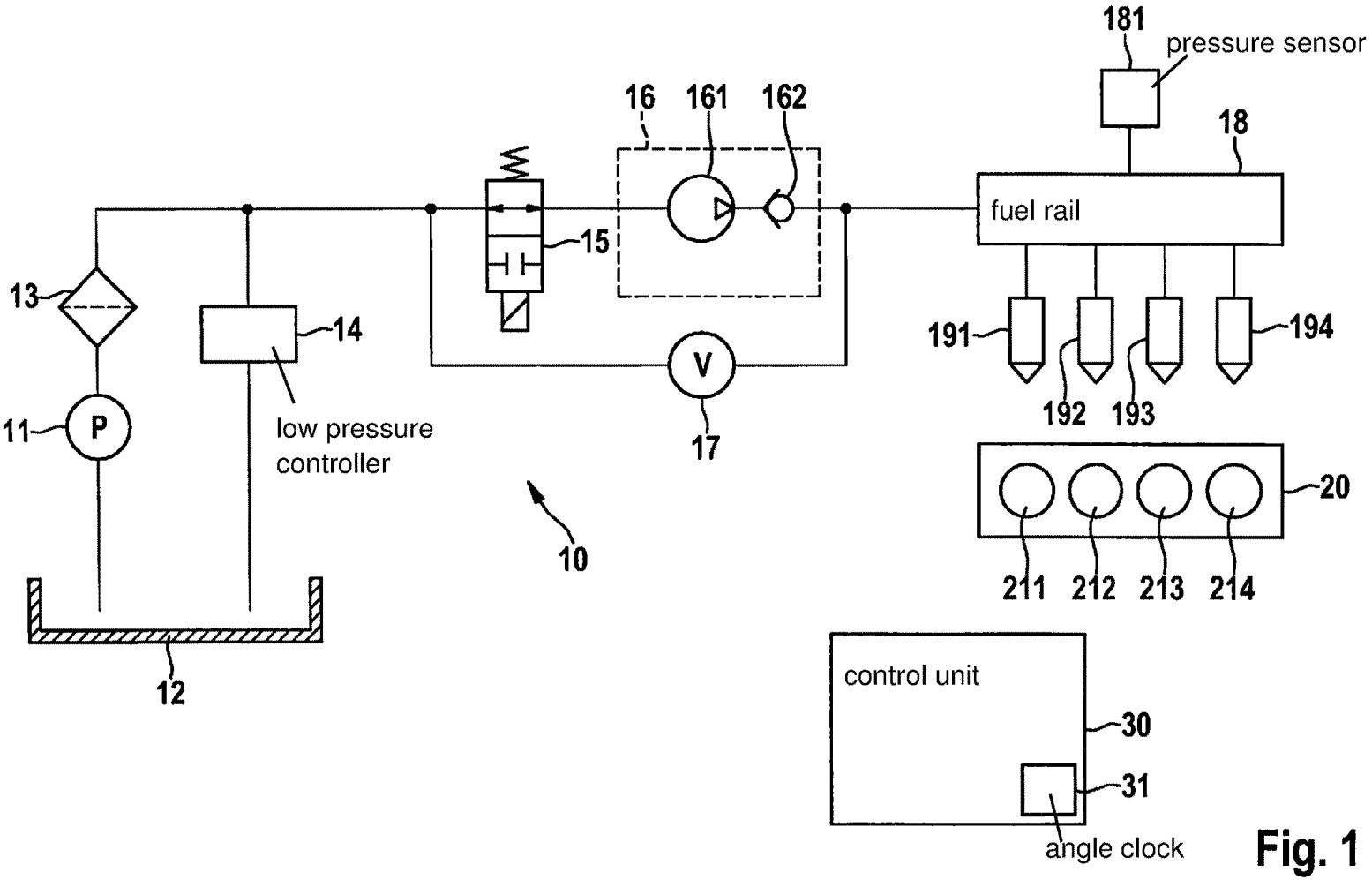
FIG. 1 schematically illustrates a fuel-injection system whose high-pressure pump is able to be controlled by a method according to an exemplary embodiment of the present invention.

A device 10 for the fuel supply of a combustion engine 20, whose high-pressure pump 16 is able to be controlled with the aid of an exemplary embodiment of the method according to the present invention, is shown in FIG. 1. It includes an electric fuel pump 11 by which fuel is conveyed from a fuel tank 12 and is forwarded through pumping via a fuel filter 13. Fuel pump 11 is suitable for generating a low pressure. A low-pressure controller 14, which is connected to the output of fuel filter 13 and via which fuel can be routed back into fuel tank 12 again, is provided for the control and/or regulation of this low pressure. In addition, a series circuit made up of a quantity-control valve 15 and a mechanical high-pressure pump 16 is connected to the output of fuel filter 13. High-pressure pump 16 has a pump module 161 and a non-return valve 162. The output of high-pressure pump 16 is routed back to the input of quantity-control valve 15 via a pressure-relief valve 17. The output of high-pressure pump 16 is furthermore connected to a fuel rail 18 as a pressure accumulator, to which a pressure sensor 181 is connected. In addition, four injectors 191, 192, 193, 194 are connected to fuel rail 18, the injectors being designed to inject fuel into one of cylinders 211, 212, 213, 214 of combustion engine 20. Fuel supply device 10 and combustion engine 20 are controlled by a control unit 30, which includes a plurality of control modules, one of them being an angle clock 31.

Figure 2:
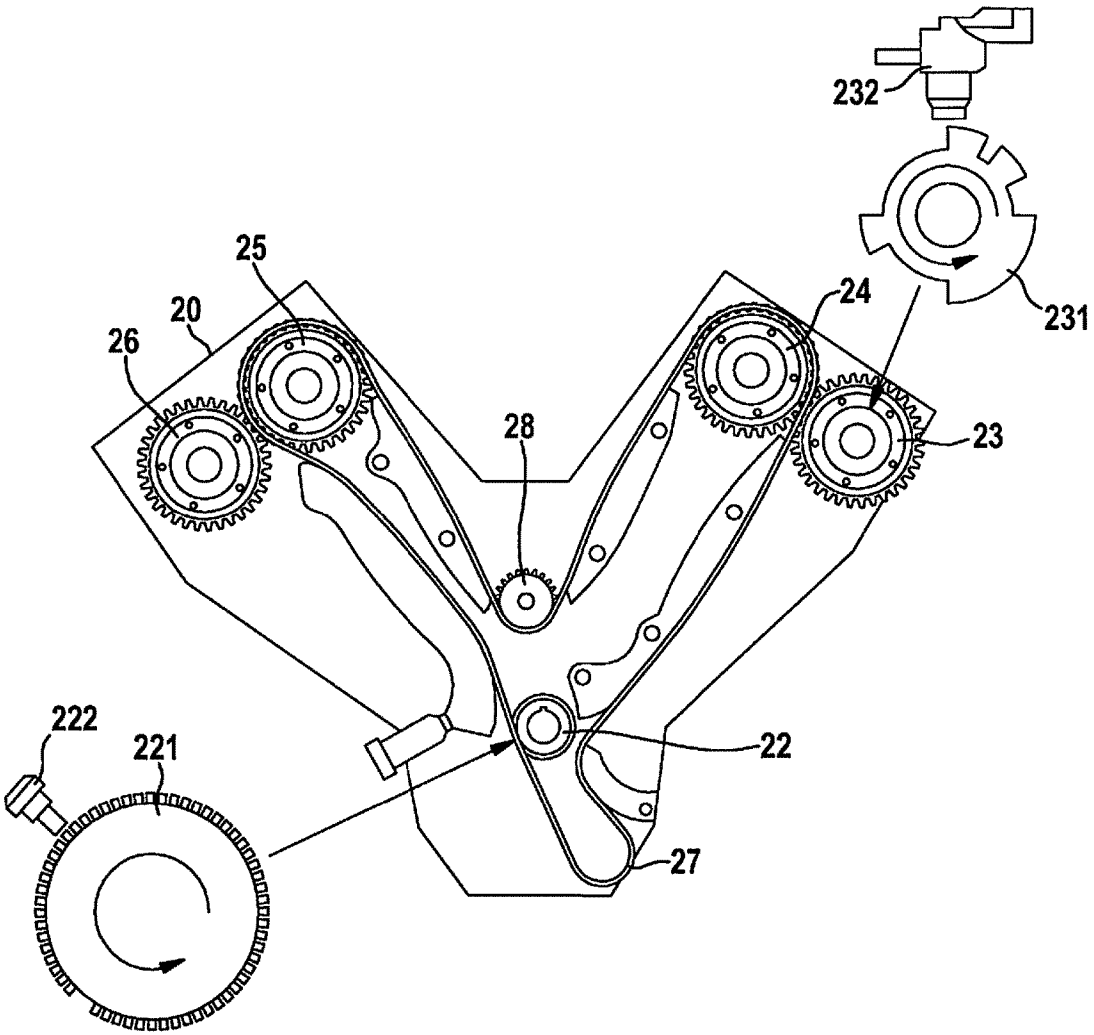
FIG. 2 shows the placement of the crankshaft and the camshafts as well as the placement of their pulse-generating wheels in a combustion engine that is supplied with fuel with the aid of the fuel injection system according to FIG. 1.

As illustrated in FIG. 2, combustion engine 20, which is shown as a V-motor in one development, has a crankshaft 22 on which a crankshaft pulse-generating wheel 221 is situated. A crankshaft position sensor 222 senses the position of the tooth flanks of crankshaft pulse-generating wheel 221 in order to ascertain the crankshaft angle. Combustion engine 20 has four camshafts 23, 24, 25, 26, which are connected to crankshaft 22 via a chain drive as a step-up gear 27. Step-up gear 27 is guided via an idler pulley 28. A camshaft pulse-generating wheel is situated on each camshaft 23, 24, 25, 26. It will be described in the following text on the basis of a camshaft pulse-generating wheel 231 on one of camshafts 23. A camshaft position sensor 232 is set up to sense a position of the tooth flanks of camshaft pulse-generating wheel 231. It has four teeth at its periphery. Each tooth has a respective tooth flank in the direction of rotation and counter to the direction of rotation of camshaft pulse-generating wheel 231. This camshaft 23 is connected to high-pressure pump 16 and includes cams (not shown) that are specifically configured for high-pressure pump 16; in conjunction with a spring, these cams ensure that the piston travel in pump module 161 of high-pressure pump 16 induces a delivery of the fuel into fuel rail 18 via non-return valve 161.

Figure 3:
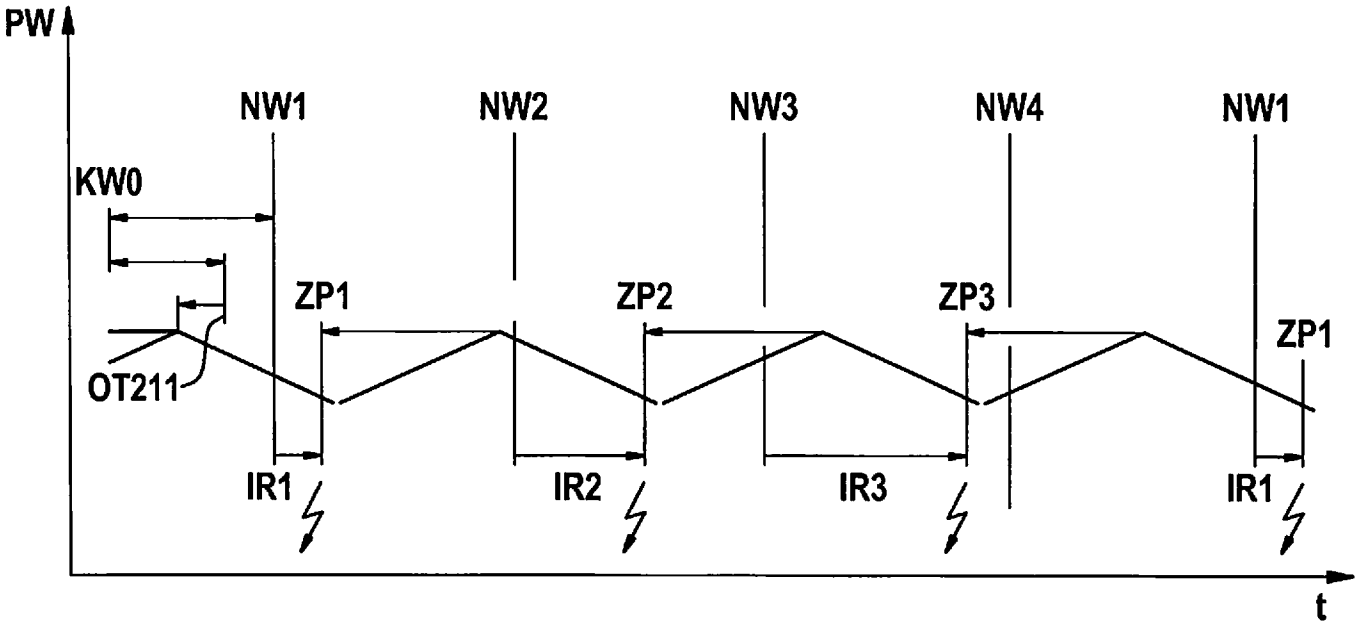
FIG. 3 shows in a diagram the movement over time of a cam in controlling a high-pressure pump in a method according to an exemplary embodiment of the present invention.

During a normal operation of combustion engine 20, the high-pressure pump 16 is controlled by producing a cam-synchronous calculation and control time frame. As may be gathered from FIG. 3, in which movement PW of a cam allocated to camshaft 23 is illustrated together with time t, an angular offset |R1, |R2, |R3 between flank positions NW1, NW2, NW3, NW4 of camshaft phase-generating wheel 231 and a predefinable point ZP1, ZP2, ZP3 above the bottom dead center of the cam is ascertained for this purpose. The bottom dead centers of the cams are shown as respective local minima, and the top dead centers of the cam are shown as respective local maxima. Each one of predefinable points ZP1, ZP2, ZP3, at which an ignition of an air-fuel mixture takes place in one of cylinders 211, 212, 213, 214 of combustion engine 20, lies before a top dead center of the cam by a constant time period, and thus also a constant camshaft angle. Starting from the first illustrated top dead center of the cam, the time interval, and thus the angle with respect to top dead center OT211 of first cylinder 211, is shown. In addition, the time interval, and thus the angle, of this top dead center OT211 of the first cylinder in relation to the second falling flank following a gap in crankshaft pulse-generating wheel 221 is depicted, the result of which is a crankshaft reference mark KWO. It is used as a reference quantity for first flank position NW1, which is able to be ascertained as corrected flank of camshaft pulse-generating wheel 231 from the signal of camshaft position sensor 232. Each angular offset |R1, |R2, |R3 is taken from a chart in which this angular offset IR1, IR2, IR3 is listed for each flank of the crankshaft pulse-generating wheel 231; in addition, an item of validity information is allocated to each angular offset |R1, |R2, |R3 in this chart, which indicates whether it is to be taken into account controlling high-pressure pump 16. In the exemplary embodiment shown in FIG. 3, angle |R4 is marked as invalid in the chart, which is why no associated angular offset |R4 has been entered following flank position NW4.

If camshaft position sensor 232 does not supply a signal because camshaft pulse-generating wheel 231 is unavailable, then a substitute value is generated for controlling high-pressure pump 16 and for the calculations that precede this control operation. For an EPM packet, a synchronization across the tooth times of crankshaft wheel 221, an evaluation of the intake manifold pressure, an ignition suppression or a test injection first takes place during the start of combustion engine 20. Once the synchronization has taken place, interrupts are read out for the calculation of the cam-synchronous control of the high-pressure pump based on motor-positional information of angle clock 31. The positions of the interrupts are calculated from previously calibrated flank positions of camshaft pulse-generating wheel 231. While the combustion engine is in operation, the adjustment of camshaft 23 is brought into the locked position. With the aid of the signal from crankshaft position sensor 222 and the output of angle clock 31, as well as a synchronization of crankshaft 22 to camshaft 23, which has already taken place during the start of the combustion engine, camshaft adjustment values from the EPM are emulated in that calibrated flanks of camshaft pulse-generating wheel 231 are forwarded. On that basis, a cam-synchronous control of high-pressure pump 16 is generated, like in a normal operation. Since no flank positions NW1, NW2, NW3, NW4 are available here, the cam-synchronous time frame is lost but substitute time frames are generated that have the correct angular position. Toward that end, the information about the non-availability of camshaft pulse-generating wheel 231 is made available as quickly as possible according to an applicable threshold value. As soon as the camshaft adjustment drives back into its locked position, the requested angles of camshaft pulse-generating wheel 231 relate to reference values of the flank positions of camshaft pulse-generating wheel 231 following the unavailability of the signal from camshaft-position sensor 223. This allows for the generation of interrupts on the basis of the substitute value with the aid of angle clock 31. If the attainment of the locked position is not directly available, then the first substitute flank should not be generated too early since it is not to be triggered given a retarded camshaft adjustment.

The start of hardware-related drivers takes place in a chronologically synchronous mode. Once a substitute camshaft-synchronous time frame has been reached, a transition to a substitute angle-synchronous mode takes place. During the further operation of combustion engine 20, the hardware-related driver requires the information that a transition to the substitute operation will take place as quickly as possible in order to cancel an already scheduled control operation of high-pressure pump 16. This avoids a full delivery as a result of an incorrect angular position, which could occur because the camshaft adjustment unexpectedly returns to its reference position. The drivers then continue their calculations in the usual manner in the substitute camshaft-synchronous time frame. All input variables of the drivers continue to be available in the substitute operation as well.

During the start of the combustion engine and in the further operation of the combustion engine, application software calculates in the substitute camshaft-synchronous time frame.

The information about the non-availability of the signal from camshaft position sensor 232 is made available to the camshaft adjustment by the EPM, which in response immediately drives back into its locked position. The reaching of the locked position is made available as information. The return value is the calibrated absolute angle in degrees of crankshaft angle, e.g., for the desired start of the actuation of quantity-control valve 15 in the reference position. All output variables and function calls for the delta angle of the camshaft adjustment nevertheless have valid values in this case and relate to the locked position.

For the task generation, the further calculations in the substitute operation are based on the substitute values of flank positions NW1, NW2, NW3, NW4 and the substitute information of the EPM. In this way, the camshaft-synchronous control of high-pressure pump 16 continues to be generated. During the start of the combustion engine, the first camshaft-synchronous time frame is already generated from substitute values. If the signal of camshaft position sensor 232 is not available during the operation of the combustion engine, a switch to the substitute values takes place so that the camshaft-synchronous time frame transitions into a substitute camshaft-synchronous time frame without the driver of a motor vehicle that is driven by combustion engine 20 becoming aware of this fact.

What is claimed is:

1. A method for controlling a high-pressure pump for injection of fuel into a combustion engine, the high-pressure pump being connected to a camshaft of the combustion engine, the method comprising:

calculating, and controlling according to the calculation, the high-pressure pump in a camshaft-synchronous manner by ascertaining an angular offset between flank positions of a camshaft pulse-generating wheel and a predefinable point above a bottom dead center of a cam of the high-pressure pump mounted on the camshaft;

wherein if a camshaft signal of the camshaft is not available, a substitute value of the camshaft signal is calculated and the high-pressure pump is controlled in synchrony using the substitute value of the camshaft signal, and the angular offset is ascertained from the substitute value;

wherein if the camshaft signal is not available during operation of the combustion engine, a camshaft adjustment of the camshaft is brought into a locked position;

wherein the substitute value is ascertained from a signal of a crankshaft position sensor of the combustion engine and an angle clock.

2. The method as recited in claim 1, wherein the angular offset is taken from a chart in which an angular offset is listed for each flank of the camshaft pulse-generating wheel and an item of information is allocated to each respective angular offset indicating whether the respective angular offset is to be taken into account in the calculation for the controlling.

3. The method as recited in claim 1, wherein the flank position is ascertained from a signal of a camshaft position sensor and the signal is corrected with regard to a dynamic adjustment of the camshaft.

4. The method as recited in claim 1, wherein the flank positions are ascertained in relation to a crankshaft reference mark of the combustion engine, the crankshaft reference mark corresponding to an angle between a top dead center of a first cylinder of the combustion engine and a second falling flank following a gap in a crankshaft pulse-generating wheel of the combustion engine.

5. The method as recited in claim 4, wherein an angle of the top dead center of the first cylinder is ascertained in relation to a top dead center of the cam of the high-pressure pump mounted on the camshaft.

6. The method as recited in claim 1, wherein a return from calculating the substitute value and controlling the high-pressure pump in synchrony using the substitute value to a camshaft-synchronous control operation takes place only when an intensity of a signal of a camshaft position sensor exceeds an applicable threshold value.

7. A non-transitory machine readable storage medium on which is stored a computer program for controlling a high-pressure pump for injection of fuel into a combustion engine, the high-pressure pump being connected to a camshaft of the combustion engine, the computer program, when executed by a computer, causing the computer to perform:

calculating, and controlling according to the calculation, the high-pressure pump in a camshaft-synchronous manner by ascertaining an angular offset between flank positions of a camshaft pulse-generating wheel and a predefinable point above a bottom dead center of a cam of the high-pressure pump mounted on the camshaft;

wherein if a camshaft signal of the camshaft is not available, a substitute value of the camshaft signal is calculated and the high-pressure pump is controlled in synchrony using the substitute value of the camshaft signal, and the angular offset is ascertained from the substitute value;

wherein if the camshaft signal is not available during operation of the combustion engine, a camshaft adjustment of the camshaft is brought into a locked position;

wherein the substitute value is ascertained from a signal of a crankshaft position sensor of the combustion engine and an angle clock.

8. An electronic control unit configured to control a high-pressure pump for injection of fuel into a combustion engine, the electronic control unit configured to calculate and control the high-pressure pump according to the calculation in a camshaft-synchronous manner by ascertaining an angular offset between flank positions of a camshaft pulse-generating wheel and a predefinable point above a bottom dead center of a cam of the high-pressure pump on the camshaft; wherein if a camshaft signal of the camshaft is not available, a substitute value of the camshaft signal is calculated and the high-pressure pump is controlled in synchrony using the substitute value of the camshaft signal, and the angular offset is ascertained from the substitute value, wherein if the camshaft signal is not available during operation of the combustion engine, a camshaft adjustment of the camshaft is brought into a locked position; and wherein the substitute value is ascertained from a signal of a crankshaft position sensor of the combustion engine and an angle clock.

* * * * *